US011508493B2

(12) United States Patent
Kim et al.

(10) Patent No.: US 11,508,493 B2
(45) Date of Patent: Nov. 22, 2022

(54) ALUMINUM ALLOY FOR CABLE CONDUCTOR

(71) Applicant: LS CABLE & SYSTEM LTD., Anyang-si (KR)

(72) Inventors: Ji Young Kim, Seoul (KR); Sangyum Kim, Anyang-si (KR); Jee Yong Park, Seongnam-si (KR)

(73) Assignee: LS CABLE & SYSTEM LTD., Anyang-si (KR)

( * ) Notice: Subject to any disclaimer, the term of this patent is extended or adjusted under 35 U.S.C. 154(b) by 453 days.

(21) Appl. No.: 16/611,676

(22) PCT Filed: Oct. 16, 2017

(86) PCT No.: PCT/KR2017/011419
§ 371 (c)(1),
(2) Date: Nov. 7, 2019

(87) PCT Pub. No.: WO2018/212412
PCT Pub. Date: Nov. 22, 2018

(65) Prior Publication Data

US 2020/0168354 A1 May 28, 2020

(30) Foreign Application Priority Data

May 17, 2017 (KR) ..... 10-2017-0060919

(51) Int. Cl.

| | |
|---|---|
| ***H01B 1/02*** | (2006.01) |
| ***C22C 21/00*** | (2006.01) |
| ***H01B 13/00*** | (2006.01) |
| ***C22F 1/04*** | (2006.01) |

(52) U.S. Cl.
CPC ..... *H01B 1/023* (2013.01); *C22C 21/00* (2013.01); *C22F 1/04* (2013.01); *H01B 13/0016* (2013.01); *H01B 13/0036* (2013.01)

(58) Field of Classification Search
None
See application file for complete search history.

(56) References Cited

U.S. PATENT DOCUMENTS

2016/0289807 A1 10/2016 Hattendorf

FOREIGN PATENT DOCUMENTS

| | | | | | |
|---|---|---|---|---|---|
| JP | 2013067864 | A | | 4/2013 | |
| KR | 1020150140709 | A | | 12/2015 | |
| KR | 20160004897 | A | * | 1/2016 | ..... C22C 38/06 |
| KR | 101716645 | B1 | | 3/2017 | |

(Continued)

OTHER PUBLICATIONS

Japanese Office Action for related Japanese Application No. 2020-506689; action dated Nov. 6, 2020; (3 pages).

(Continued)

*Primary Examiner* — George Wyszomierski
*Assistant Examiner* — Janell C Morillo
(74) *Attorney, Agent, or Firm* — K&L Gates LLP

(57) ABSTRACT

Provided is an aluminum alloy for a cable conductor. Specifically, the present invention relates to an aluminum alloy for a cable conductor, which is excellent in both mechanical properties, such as tensile strength, at room temperature and high temperatures and elongation, and electrical conductivity, is simple to manufacture at low costs, and is eco-friendly.

6 Claims, 1 Drawing Sheet

(56) References Cited

FOREIGN PATENT DOCUMENTS

| | | |
|---|---|---|
| WO | 2016003068 A1 | 1/2016 |
| WO | 2016088888 A1 | 6/2016 |

OTHER PUBLICATIONS

International Search Report for related International Application No. PCT/KR2017/011419; report dated Nov. 22, 2018; (4 pages).
Written Opinion for related International Application No. PCT/KR2017/011419; report dated Nov. 22, 2018; (5 pages).

* cited by examiner

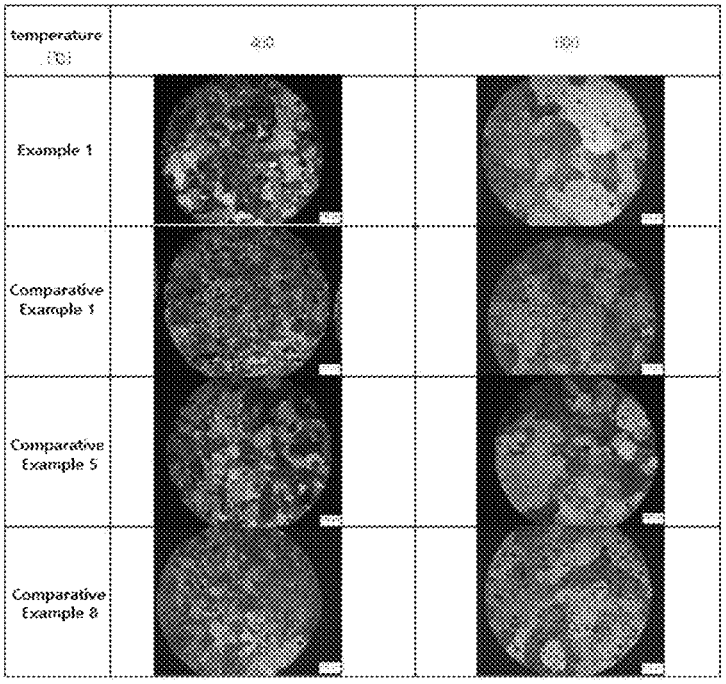
temperature (°C)
Example 1
Comparative Example 1
Comparative Example 5
Comparative Example 8

ALUMINUM ALLOY FOR CABLE CONDUCTOR

CROSS-REFERENCE TO RELATED APPLICATIONS

The present application is a National Stage of International Application No. PCT/KR2017/011419, filed Oct. 16, 2017 which claims priority to Korean Application No. 10-2017-0060919, filed May 17, 2017, the disclosure of which are incorporated herein by reference.

FIELD OF THE INVENTION

The present invention relates to an aluminum alloy for a cable conductor. Specifically, the present invention relates to an aluminum alloy for a cable conductor, which is excellent in both mechanical properties, such as tensile strength, at room temperature and high temperatures and elongation, and electrical conductivity, is simple to manufacture at low costs, and is eco-friendly.

BACKGROUND OF THE INVENTION

Aluminum conductor wire is lighter and cheaper than copper conductor wire and copper alloy conductor wire. In addition, aluminum has been widely used for overhead transmission lines, underground transmission lines, cables for buildings, etc., because it is easy to cast, is easy to be used in alloys with other metals, is easy to process at room temperature and high temperatures, and has excellent corrosion resistance and durability in the air.

However, pure aluminum is excellent in elongation, electrical conductivity, etc. but is insufficient in mechanical strength such as tensile strength. In particular, when used for conductors of cables in a highly vibrated environment, e.g., automobiles, planes, motors, etc., mechanical strength which is a factor for determining resistance to vibration should be improved.

Therefore, related art of improving the mechanical strength of an aluminum alloy through alloying of aluminum (Al) with an alloying element such as iron (Fe), copper (Cu), magnesium (Mg), zirconium (Zr), and beryllium (Be) has been known.

However, in the case of an existing aluminum alloy, an excessive amount of an alloying element should be added thereto to achieve desired mechanical strength and thus elongation, electrical conductivity, etc. which are in a tradeoff relation with the mechanical strength decrease greatly or should be heat treated at high treatments or for a long time for manufacture. Furthermore, environmental problems may occur and manufacture costs may increase due to the addition of beryllium (Be) which is an environmentally regulated material.

In addition, when a small amount of an alloying element is added to the aluminum alloy to avoid a large decrease in elongation, electrical conductivity, etc., the mechanical strength of the aluminum alloy is insufficiently improved or a grain refinement process is additionally required to improve the mechanical strength of the aluminum alloy, thereby complicating a manufacturing process.

Under this circumstance, in the current mainstream cable industry, research is being actively conducted on improvement of both mechanical strength, such as tensile strength, of aluminum alloys and elongation, electrical conductivity, etc. which are in a tradeoff relation with the mechanical strength so as to replace copper conductor wire and copper alloy conductor wire with aluminum alloy conductor wire. However, there are many difficulties in technological progress because an optimal combination of alloying elements and process conditions for aluminum alloys have yet to be established.

Therefore, there is an urgent need for an aluminum alloy for cable conductors, which is excellent both in mechanical properties, such as tensile strength and elongation, at room temperature and high temperatures, and electrical conductivity, is simple to manufacture at low costs, and is eco-friendly.

BRIEF SUMMARY OF THE INVENTION

The present invention is directed to providing an aluminum alloy for a cable conductor, which is excellent in both mechanical properties, such as tensile strength and elongation, at room temperature and high temperature and electrical conductivity.

The present invention is also directed to providing an aluminum alloy for a cable conductor, which is simple to manufacture at low costs and is eco-friendly.

According to an aspect of the present invention, provided is an aluminum alloy for a cable conductor, comprising iron (Fe), copper (Cu), boron (B) and titanium (Ti), wherein a particle diameter growth rate defined by the following Equation 1 is 30 to 70%:

$$\text{particle diameter growth rate}(\%)=(a-b)/b*100, \quad \text{[Equation 1]}$$

wherein a represents an average particle diameter of crystal grains measured after heat treating the aluminum alloy at 600° C. for 1 hour, and b represents an average particle diameter of crystal grains measured after heat treating the aluminum alloy at 400° C. for 1 hour.

According to another aspect of the present invention, provided is the aluminum alloy, wherein a wire rod of the aluminum alloy drawn to a diameter of 0.4 mm has tensile strength of 140 MPa or more, elongation of 15% or more, and electrical conductivity of 59% IACS or more.

According to other aspect of the present invention, provided is the aluminum alloy, further comprising at least one intermetallic compound selected from the group consisting of an Al-Fe intermetallic compound, an Al-Cu intermetallic compound and an Al-Ti intermetallic compound.

According to other aspect of the present invention, provided is the aluminum alloy, wherein the iron (Fe) is contained in an amount of 0.3 to 0.6 wt %, the copper (Cu) is contained in an amount of 0.3 to 0.5 wt %, the boron (B) is contained in an amount of 0.001 to 0.01 wt %, and the titanium (Ti) is contained in an amount of 0.01 to 0.03 wt %, based on total weight of the aluminum alloy.

According to other aspect of the present invention, provided is the aluminum alloy, wherein impurities selected from the group consisting of vanadium (V), chromium (Cr) and nickel (Ni) are contained in an amount of 0.1 wt % or less, based on total weight of the aluminum alloy.

According to other aspect of the present invention, provided is the aluminum alloy, wherein each of vanadium (V), chromium (Cr) and nickel (Ni) is contained in an amount of 0.01 wt % or less, based on the total weight of the aluminum alloy.

According to other aspect of the present invention, provided is the aluminum alloy, wherein tensile strength when the aluminum alloy is heat-treated at 310° C. for six hours after being drawn is 90% or more of tensile strength before the heat treatment is performed.

According to other aspect of the present invention, provided is a cable conductor manufactured by preparing a rod by continuous casting and rolling by adjusting pouring temperature of the aluminum alloy to 720 to 780° C., drawing the rod to a diameter of 0.4 mm, and performing heat treatment thereon at 310° C. for six hours.

An aluminum alloy for a cable conductor according to the present invention is excellent in improving all tensile strength at room temperature and high temperatures and elongation and electrical conductivity, etc., which are in a tradeoff relation with the tensile strength, through selection of specific alloying elements, a mixing ratio, and a particle diameter growth rate precisely controlled when heating.

In addition, the aluminum alloy for a cable conductor according to the present invention is simple to manufacture at low costs because an additional high-temperature and long-time heat treatment and an additional grain refinement process are not needed, and is eco-friendly because environmentally regulated materials can be excluded as alloying elements.

BRIEF DESCRIPTION OF THE DRAWINGS

FIG. 1 shows optical microscope photographs according to ASTM E112, taken after performing heat treatment on aluminum alloys of example 1 and comparative examples 1, 5 and 8 at 400 and 600° C.

DETAILED DESCRIPTION OF THE INVENTION

Hereinafter, exemplary embodiments of the present invention will be described in detail. The present invention is, however, not limited thereto and may be embodied in many different forms. Rather, the embodiments set forth herein are provided so that this disclosure may be thorough and complete and fully convey the scope of the invention to those skilled in the art.

The present invention relates to an aluminum alloy for a cable conductor.

The aluminum alloy may include alloying elements such as iron (Fe), copper (Cu), boron (B), and titanium (Ti) and other alloying elements added inevitably in a manufacturing process, as well as aluminum (Al).

As an alloying element, iron (Fe) is present in a matrix in the form of an Al-Fe intermetallic compound. In particular, the Al-Fe intermetallic compound is mostly precipitated and suppresses the growth of crystal grains during a heat treatment operation in a manufacturing process of the aluminum alloy conductor, thereby improving mechanical strength such as tensile strength.

Here, the iron (Fe) may be contained in an amount of 0.3 to 0.6 wt %, based on total weight of the aluminum alloy. When the amount of the iron (Fe) is less than 0.3 wt %, a degree of improvement of the mechanical strength of the aluminum alloy may be insufficient. When the amount of the iron (Fe) is greater than 0.6 wt %, the Al-Fe intermetallic compound is coarse and thus the extrudability of a molten aluminum alloy may decrease and elongation, electrical conductivity, etc. of the aluminum alloy may decrease greatly.

As an alloying element, copper (Cu), when dissolved in aluminum, increases a corrosion potential of the aluminum alloy, thereby improving corrosion resistance of the aluminum alloy, and is present in a matrix in the form of an Al-Cu intermetallic compound and is precipitated and suppresses growth of crystal grains during the heat treatment operation, similar to iron (Fe), thereby improving mechanical strength such as tensile strength.

Here, copper (Cu) may be contained in an amount of 0.3 to 0.5 wt %, based on the total weight of the aluminum alloy. When the amount of copper (Cu) is less than 0.3 wt %, a degree of improvement of the mechanical strength of the aluminum alloy is insufficient. When the amount of copper (Cu) is greater than 0.5 wt %, an intermetallic compound is coarse and thus the extrudability of a molten aluminum alloy may decrease and elongation, electrical conductivity, etc. of the aluminum alloy may decrease greatly.

As an alloying element, boron (B) promotes the precipitation of intermetallic compounds and suppresses coarsening of crystal grains during the heat treatment operation of the manufacturing process of the aluminum alloy, thereby improving the strength of the aluminum alloy and suppressing a decrease in electrical conductivity.

Here, the boron (B) may be contained in an amount of 0.001 to 0.01 wt %, based on the total weight of the aluminum alloy. When the amount of the boron (B) is less than 0.001 wt %, a degree of improvement of the mechanical strength of the aluminum alloy may be insufficient. When the amount of the boron (B) is greater than 0.01 wt %, intermetallic compounds may be excessively generated and thus the electrical conductivity of the aluminum alloy may decrease greatly.

As an alloying element, titanium (Ti) has a melting point of about 1,800° C., which is higher than the melting point of about 1,540° C. of iron (Fe) and the melting point of about 1084.5° C. of copper (Cu) and thus is added in the form of a titanium diboride ($TiB_2$) compound, a rod of aluminum titanium diboride (Al-Ti-$B_2$), or the like, is uniformly present in the aluminum alloy as a precipitate in the form of an Al-Ti intermetallic compound, e.g., Al-$Al_3$Ti-$TiB_2$, thereby additionally reducing an average distance between precipitates, which determines the size of crystal grains of the aluminum alloy. Therefore, the strength of the aluminum alloy can be additionally improved through grain refinement.

In addition, grain refinement of an aluminum alloy to which titanium (Ti) is added may be achieved through an Al-Ti precipitate as described above. Therefore, even when heat treatment is performed at a higher temperature for a longer time to improve elongation of the aluminum alloy, a degree to which tensile strength decreases is far lower than when titanium (Ti) is not added to the aluminum alloy and thus the elongation thereof is far higher than those of other aluminum alloys to which titanium (Ti) is not added and which have the same tensile strength.

Here, the titanium (Ti) may be contained in an amount of 0.01 to 0.03 wt %, based on the total weight of the aluminum alloy. When the amount of titanium (Ti) is less than 0.01 wt %, it is difficult to achieve an effect of grain refinement of the aluminum alloy. In contrast, when the amount of titanium (Ti) is greater than 0.03 wt %, a large amount of impurities may be added to the aluminum alloy and thus coarse intermetallic compounds may be generated, thereby reducing the extrudability of a molten aluminum alloy and the tensile strength and electrical conductivity of the aluminum alloy.

Impurities inevitably added in the manufacturing process of the aluminum alloy may include vanadium (V), chromium (Cr), nickel (Ni), etc. Each of the unavoidable impurities may be contained in an amount of 0.01 wt % or less and the total amount of the unavoidable impurities may be 0.1 wt % or less, based on the total weight of the aluminum alloy.

A particle diameter growth rate according to Equation 1 above may be 30 to 70%, because the aluminum alloy contains the alloying elements in the mixing ratio and drawing and heat treatment process conditions are controlled. Thus, even after being drawn and heat-treated at 310° C. for 6 hours, the tensile strength may be 90% or more, e.g., 140 MPa or more, of that before the heat treatment.

$$\text{Particle diameter growth rate}(\%)=(a-b)/b*100 \quad \text{[Equation 1]}$$

In Equation 1 above, a represents an average particle diameter of crystal grains measured after the aluminum alloy is heat-treated at 600° C. for 1 hour, and b represents an average particle diameter of crystal grains measured after the aluminum alloy is heat-treated at 400° C. for 1 hour.

Here, the particle diameter of the crystal grains is the same as the diameter of a circle having the same cross-sectional area as the crystal grains, and the average particle diameter of the crystal grains refers to an average of the particle diameters of the crystal grains.

In Equation 1 above, a particle diameter growth rate is low when heat treatment temperature of the aluminum alloy is less than 600° C. in relation to the average particle diameter a or is greater than 400° C. in relation to the average particle diameter b, and is excessive when the heat treatment temperature of the aluminum alloy is greater than 600° C. in relation to the average particle diameter a or is less than 400° C. in relation to the average particle diameter b. Thus, the particle diameter growth rate cannot be used as a criterion for evaluation of a meaningful feature.

When the particle diameter growth rate defined by Equation 1 above is less than 30%, the particle diameter of the aluminum alloy has already been coarse and thus was not grown to a large extent even when heated and therefore the tensile strength thereof at room temperature is insufficient. In contrast, when the particle diameter growth rate defined by Equation 1 above is greater than 70%, heat resistance thereof is insufficient and thus tensile strength may decrease to a large extent at high temperatures, i.e., a wire usage temperature, and boron (Bi) and titanium (Ti) may be dissolved due to excessive casting temperature, thereby reducing electrical conductivity.

A particle diameter growth rate of an aluminum alloy according to the present invention, which is defined by Equation 1 above, is controlled to be 30 to 70%. Thus, a wire rod of the aluminum alloy drawn to a diameter of 0.4 mm may have high tensile strength of 140 MPa or more, and elongation and electrical conductivity thereof which are in a tradeoff relation with the tensile strength may be respectively 15% or more and 59% IACS or more.

EXAMPLES

1. Preparation Examples

Each of aluminum alloy wire rod samples according to examples and comparative examples was manufactured by preparing a molten aluminum alloy using alloying elements in amounts shown in Table 1 below, making a rod by continuous casting and rolling, drawing the rod to a diameter of 0.4 mm, and performing a heat treatment process thereon (for 6 hours at 310° C.). Units of the amounts shown in Table 1 below are wt %.

TABLE 1

| | iron (Fe) | copper (Cu) | boron (B) | titanium (Ti) | casting temperature (° C.) |
|---|---|---|---|---|---|
| example 1 | 0.50 | 0.35 | 0.004 | 0.020 | 720 to 780 |
| example 2 | 0.43 | 0.40 | 0.004 | 0.020 | 720 to 780 |
| example 3 | 0.53 | 0.36 | 0.001 | 0.010 | 720 to 780 |
| example 4 | 0.51 | 0.35 | 0.010 | 0.030 | 720 to 780 |
| comparative example 1 | 0.71 | 0.36 | 0.004 | 0.020 | 720 to 780 |
| comparative example 2 | 0.45 | 0.10 | 0.004 | 0.020 | 720 to 780 |
| comparative example 3 | 0.51 | 0.35 | 0.000 | 0.000 | 720 to 780 |
| comparative example 4 | 0.45 | 0.60 | 0.004 | 0.020 | 720 to 780 |
| comparative example 5 | 0.50 | 0.35 | 0.004 | 0.020 | 600 to 700 |
| comparative example 6 | 0.50 | 0.35 | 0.004 | 0.020 | 800 to 900 |
| comparative example 7 | 0.53 | 0.36 | 0.001 | 0.010 | 600 to 700 |
| comparative example 8 | 0.53 | 0.36 | 0.001 | 0.010 | 800 to 900 |

2. Evaluation of Physical Properties

1) Measurement of Tensile Strength and Elongation

A force required to pull each of the aluminum alloy wire rod samples of the examples and the comparative examples at a speed of 1 mm/s was measured according to the ASTM B557 standard while fixing both ends thereof using a wire gripping device, tensile strength of each sample was calculated by an offset method, and elongation thereof was measured on the basis of a length of each sample when each sample was broken was measured. A sample having tensile strength of less than 140 MPa or elongation of less than 15% was evaluated as defective.

2) Measurement of Electrical Conductivity

Electrical conductivity of each of the aluminum alloy wire rod samples of the examples and the comparative examples was calculated by measuring electric resistance by the Calvin Double Bridge method according to the ASTM B193 standard.

3) Measurement of Particle Diameter Growth Rate

A particle diameter growth rate of each of the aluminum alloy wire rod samples of the examples and the comparative examples was calculated by Equation 1 above by respectively heat-treating it for 1 hour at 400° C. and 600° C. and then measuring particle diameters thereof. A sample with a particle diameter growth rate beyond a range of 30 to 70% was evaluated as defective.

Specifically, the measurement of the particle diameters was performed by mirror polishing a cross section of each of the aluminum alloy wire rod samples of the examples and the comparative examples to 1 μm diamond suspension, electrolytic etching the cross section with an aqueous solution which is a mixture of 200 mℓ of distilled water and 5 mℓ of $HBF_4$ for 2 minutes and 40 seconds under a 24 V condition, and measuring an average particle diameter on the basis of a microstructure photograph taken with an optical microscope according to ASTM E112.

A result of the evaluation of the physical properties are as shown in Table 2 below and FIG. 1.

TABLE 2

| | evaluation of particle diameter growth rate | | | | | |
|---|---|---|---|---|---|---|
| | 400° C. average particle diameter (b) (μm) | 600° C. average particle diameter (a) (μm) | particle diameter growth rate (%) | tensile strength (MPa) | elongation (%) | electrical conductivity (% IACS) |
| example 1 | 198.7983 | 314.9480 | 58 | 145.1 | 16.5 | 59.6 |
| example 2 | 191.5314 | 258.4587 | 35 | 141.6 | 16.0 | 59.3 |
| example 3 | 197.5468 | 264.3215 | 34 | 141.5 | 16.0 | 59.4 |
| example 4 | 188.6764 | 286.5127 | 52 | 144.8 | 15.9 | 59.3 |
| Comparative example 1 | 120.0251 | 199.3847 | 66 | 147.7 | 14.8 | 57.8 |
| Comparative example 2 | 148.6429 | 196.5483 | 32 | 125.4 | 15.3 | 59.9 |
| Comparative example 3 | 226.4819 | 289.1584 | 28 | 128.4 | 15.2 | 60.0 |
| Comparative example 4 | 118.4869 | 228.5874 | 93 | 145.2 | 15.3 | 57.9 |
| Comparative example 5 | 171.7954 | 219.6205 | 28 | 137.5 | 14.8 | 59.2 |
| Comparative example 6 | 110.5431 | 195.6063 | 77 | 142.4 | 15.3 | 58.1 |
| Comparative example 7 | 194.7748 | 220.2649 | 13 | 135.4 | 15.7 | 59.7 |
| Comparative example 8 | 136.9001 | 254.7010 | 86 | 146.2 | 15.5 | 57.6 |

As shown in Table 2 above, a particle growth rate of each of the aluminum alloys of examples 1 to 4 according to the present invention was controlled to be 30 to 70% when heated and thus all tensile strength of each of wire rods of the aluminum alloys and elongation and electrical conductivity thereof which are in a tradeoff relation with the tensile strength were high. In particular, tensile strength was high, i.e., 140 MPa or more, after heat treatment.

In contrast, the aluminum alloy of comparative example 1 contains an excessive amount of iron (Fe) and thus elongation and electrical conductivity thereof were below a standard. The aluminum alloy of comparative example 2 contains an insufficient amount of copper (Cu) and thus tensile strength of a wire rod of the aluminum alloy was below a standard. In the aluminum alloy of comparative example 3, boron (B) and titanium (Ti) were not added and thus formation of precipitates was hindered, thereby coarsening crystal grains, and consequently, tensile strength decreased greatly during heat treatment performed to improve elongation. The aluminum alloy of comparative example 4 contains an excessive amount of copper (Cu) and thus a particle diameter growth rate was greatly increased when heated and electrical conductivity was below a standard.

The aluminum alloys of comparative examples 5 and 7 were manufactured by casting at a temperature below a standard and thus particle diameter growth rates were less than 30%. This means that particle sizes of the aluminum alloys were already coarse and thus was not grown significantly even after heated. Therefore, tensile strength was below a standard at room temperature. The aluminum alloys of comparative examples 6 and 8 were manufactured by casting at a temperature above the standard and thus particle diameter growth rates were greater than 70%. This means that boron (B) and titanium (Ti) were dissolved in the aluminum alloys and thus electrical conductivity decreased. It was confirmed that electrical conductivity was actually below the standard.

While the present invention has been described above with respect to exemplary embodiments thereof, it would be understood by those of ordinary skilled in the art that various changes and modifications may be made without departing from the technical conception and scope of the present invention defined in the following claims. Thus, it is clear that all modifications are included in the technical scope of the present invention as long as they include the components as claimed in the claims of the present invention.

The invention claimed is:

1. An aluminum alloy for a cable conductor, comprising iron (Fe), copper (Cu), boron (B), and titanium (Ti), wherein the iron (Fe) is contained in an amount of 0.3 to 0.6 wt %, the copper (Cu) is contained in an amount of 0.3 to 0.5 wt %, the boron (B) is contained in an amount of 0.001 to 0.01 wt %, and the titanium (Ti) is contained in an amount of 0.01 to 0.03 wt %, based on total weight of the aluminum alloy, wherein a particle diameter growth rate defined by the following Equation 1 is 30 to 70%:

$$\text{particle diameter growth rate}(\%)=(a-b)/b*100, \quad \text{[Equation 1]}$$

wherein a represents an average particle diameter of crystal grains measured after heat treating the aluminum alloy at 600° C. for 1 hour, and b represents an average particle diameter of crystal grains measured after heat treating the aluminum alloy at 400° C. for 1 hour, wherein said aluminum alloy is drawn into a wire rod with a diameter of 0.4 mm, and exhibits a tensile strength of 140 MPa or more, elongation of 15% or more, and electrical conductivity of 59% IACS or more.

2. The aluminum alloy of claim 1, further comprising at least one intermetallic compound selected from the group consisting of an Al-Fe intermetallic compound, an Al-Cu intermetallic compound and an Al-Ti intermetallic compound.

3. The aluminum alloy of claim 1, wherein a total amount of impurities selected from the group consisting of vanadium (V), chromium (Cr) and nickel (Ni) is 0.1 wt % or less, based on total weight of the aluminum alloy.

4. The aluminum alloy of claim 3, wherein each of vanadium (V), chromium (Cr) and nickel (Ni) is contained in an amount of 0.01 wt % or less, based on the total weight of the aluminum alloy.

5. The aluminum alloy of claim 1, wherein tensile strength when the aluminum alloy is heat-treated at 310° C. for six hours after being drawn is 90% or more of tensile strength before the heat treatment is performed.

6. A cable conductor manufactured by preparing a rod by continuous casting and rolling by adjusting pouring temperature of the aluminum alloy of claims 1 to 720 to 780° C., drawing the rod to a diameter of 0.4 mm, and performing heat treatment thereon at 310° C. for six hours.

* * * * *